US006845928B1

(12) United States Patent
Felgen

(10) Patent No.: US 6,845,928 B1
(45) Date of Patent: Jan. 25, 2005

(54) GAS WIPING NOZZLE FOR A WIRE COATING APPARATUS

(75) Inventor: Fernand Felgen, Mersch (LU)

(73) Assignee: Trefilarbed Bissen SA, Bissen (LU)

( * ) Notice: Subject to any disclaimer, the term of this patent is extended or adjusted under 35 U.S.C. 154(b) by 554 days.

(21) Appl. No.: 10/031,714

(22) PCT Filed: Jul. 3, 2000

(86) PCT No.: PCT/EP00/06176

§ 371 (c)(1),
(2), (4) Date: Jan. 18, 2002

(87) PCT Pub. No.: WO01/07675

PCT Pub. Date: Feb. 1, 2001

(30) Foreign Application Priority Data

Jul. 23, 1999 (LU) ..... 90421

(51) Int. Cl.[7] ..... B05B 1/00

(52) U.S. Cl. ..... 239/589; 239/590; 239/71; 239/115; 239/104; 118/63; 118/65; 118/419

(58) Field of Search ..... 239/71, 72, 104, 239/105, 114, 115, 589, 590, 590.3, 591, 597, DIG. 21; 118/63, 65, 69, 419, 423

(56) References Cited

U.S. PATENT DOCUMENTS 3,607,366 A * 9/1971 Kurokawa ..... 118/63
3,841,557 A * 10/1974 Atkinson ..... 239/597
4,172,911 A * 10/1979 Michels ..... 118/65
4,392,613 A * 7/1983 Graff et al. ..... 239/115
4,958,589 A * 9/1990 Homma et al. ..... 118/423
5,066,519 A * 11/1991 Robertson ..... 118/63
5,255,853 A * 10/1993 Munoz ..... 239/590.3

FOREIGN PATENT DOCUMENTS

| | | |
|---|---|---|
| EP | 0 038 036 | 10/1981 |
| EP | 0 038 975 | 11/1981 |
| EP | 0 103 238 | 3/1984 |
| EP | 0 566 497 A1 | 10/1993 |
| FR | 2.136.001 | 12/1972 |
| JP | 56098466 | 8/1981 |
| JP | 06287736 | 10/1994 |
| JP | 10298727 | 11/1998 |

* cited by examiner

*Primary Examiner*—Steven J. Ganey
(74) *Attorney, Agent, or Firm*—McCormick, Paulding & Huber LLP

(57) ABSTRACT

A gas wiping nozzle for a wire coating apparatus includes an inlet portion defining a converging inlet passage for a coated wire that is axially drawn through the gas wiping nozzle. A wiping portion is further included and defines a wiping passage for the coated wire, downstream and in an axial extension of the inlet passage. The wiping portion has a gas outlet surrounding the wiping passage for blowing wiping gas onto the coated wire. A protruding annular lip is arranged between the converging inlet passage and the wiping passage, and the annular lip defining a passage for the coated wire that is narrower than the wiping passage so that the gas outlet means in the wiping passage is protected by the protruding annular lip against direct contact with the coated wire which is axially drawn through the passages of the wiping gas.

12 Claims, 2 Drawing Sheets

Fig. 1
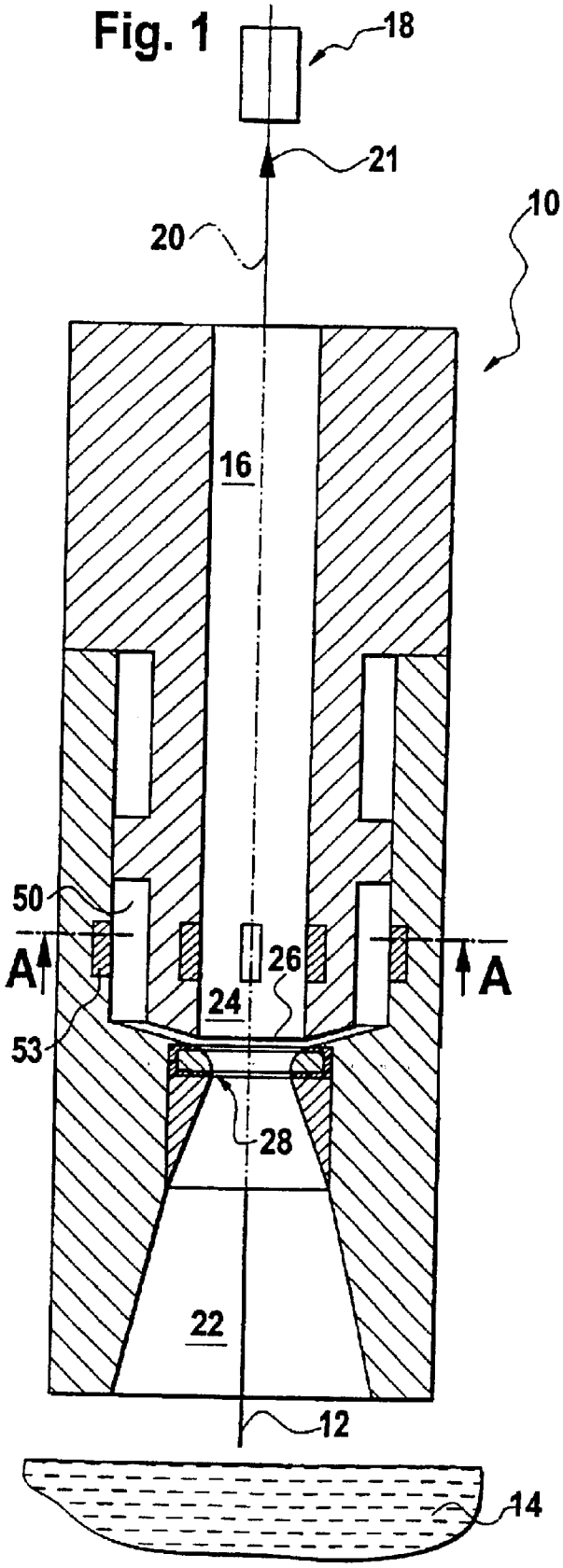
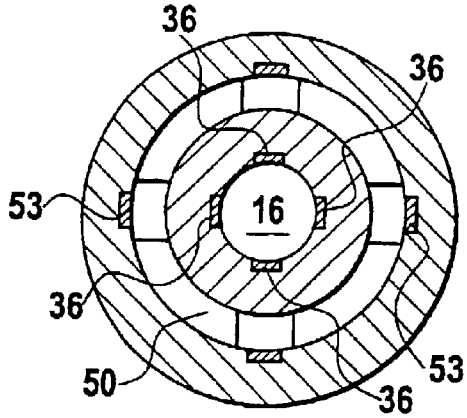
Fig. 3
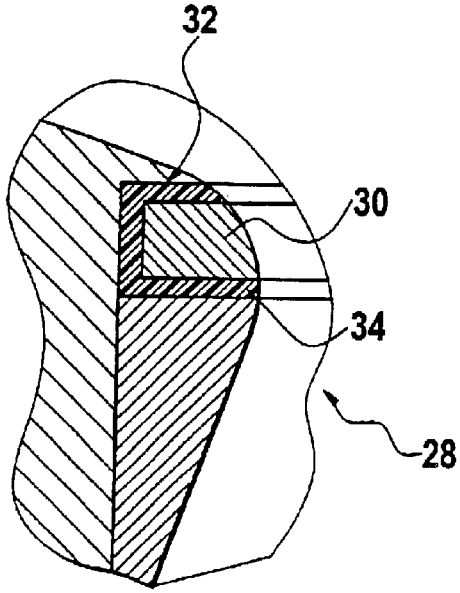
Fig.2

Fig. 4
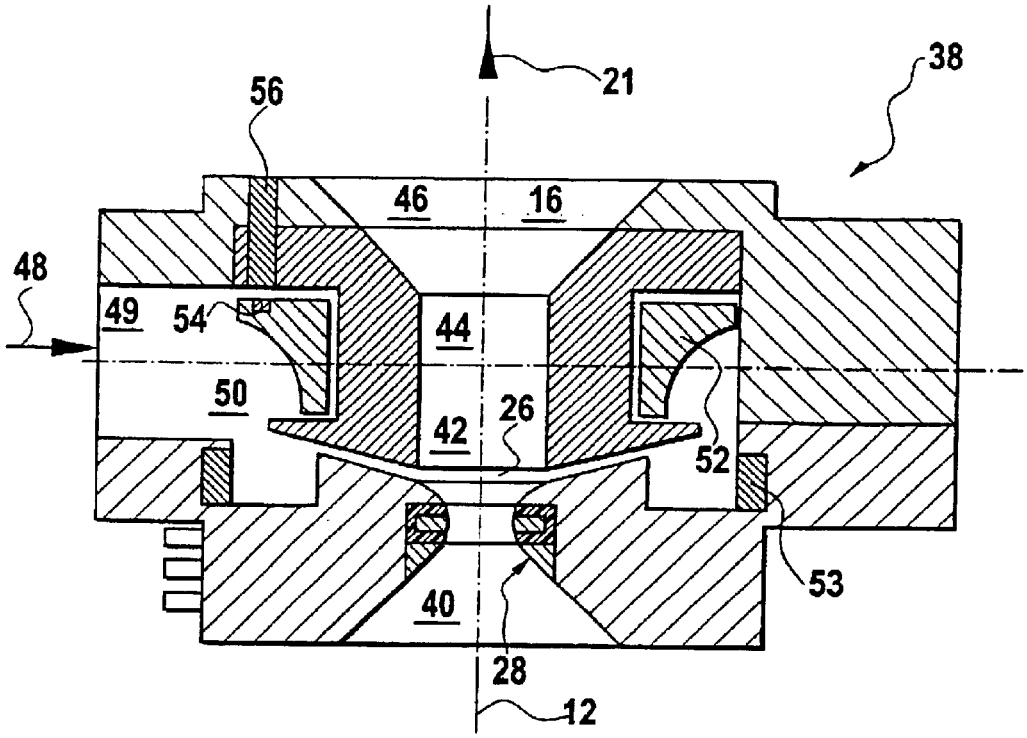
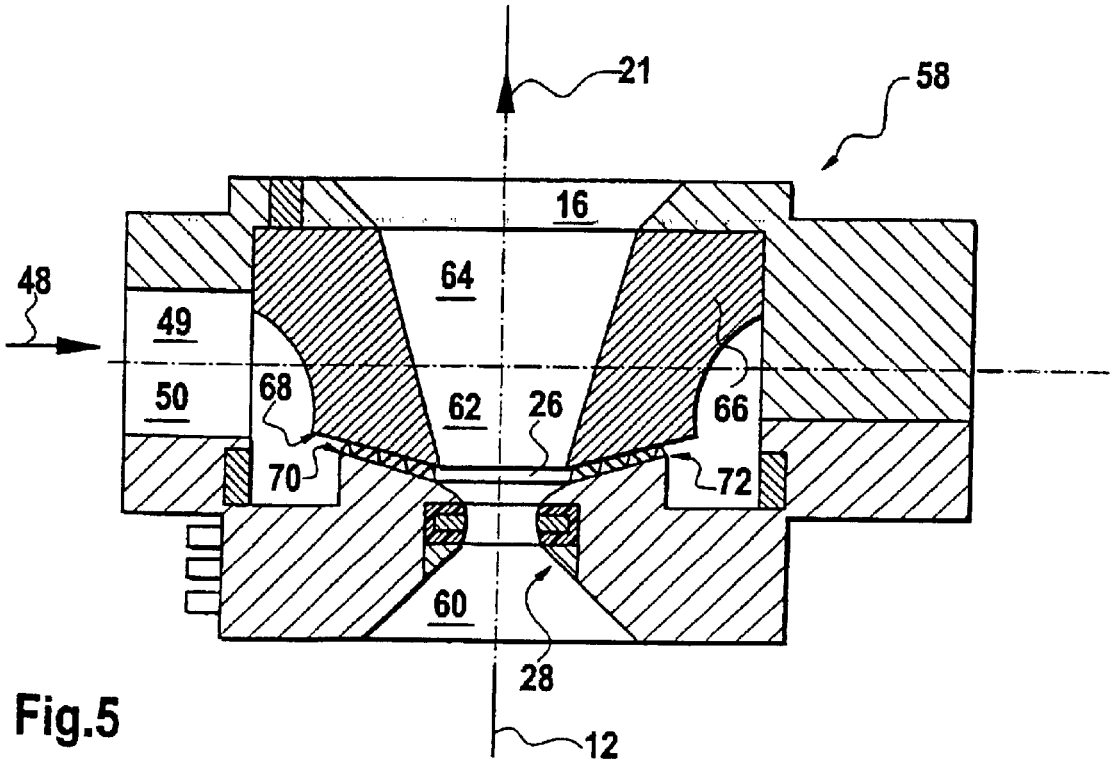
Fig.5

GAS WIPING NOZZLE FOR A WIRE COATING APPARATUS

FILED OF THE INVENTION

The present invention relates to a gas wiping nozzle for a wire coating apparatus.

BACKGROUND OF THE INVENTION

A metallic wire is commonly coated by passing the wire through a bath of molten metal, such as molten zinc, molten zinc alloy, or molten aluminum. After emerging from the molten metal bath, the wire is drawn through a gas wiping nozzle, in order to obtain a uniform metal coating upon the substrate metal, by wiping the excess of molten metal.

Such a gas wiping nozzle is e.g. disclosed in EP-A-0 357 297. The nozzle has an upper annular part and a lower annular part. Each of the annular parts have an upper and lower surface meeting in a substantially sharp annular edge, adjacent surfaces of the upper and lower annular parts defining between them an annular gas passage operatively connected to a source of pressurized gas and terminating in an annular gas orifice. The edges and the gas orifice define a wire orifice through which passes a wire coated with molten metal, which is therein wiped by the gas blown through the gas passage.

This gas wiping nozzle is efficient for wiping excess molten metal from the surface of a wire, but it can be easily damaged by molten metal. Indeed, during the coating process, the molten metal coated wire is generally drawn along a drawing axis centered in the wire orifice. The molten metal coated wire can deviate from its drawing axis and contacts directly the annular gas passage, the molten metal thence filling in the gas passage, solidifying therein and therefore obstructing it. From that point on, the molten metal coated wire passing through the nozzle is not properly wiped and does no longer meet the quality requirements. The gas wiping nozzle has to be cleaned or replaced.

SUMMARY OF THE INVENTION

The object of the present invention is to provide a gas wiping nozzle which avoids or alleviates the above-mentioned problems. According to the present invention, this object is achieved by a gas wiping nozzle according to claim 1.

In accordance with the present invention, a gas wiping nozzle for a wire coating apparatus comprises a passage for a wire being drawn therethrough along a central axis. This passage includes a converging inlet section through which the wire coated with molten metal enters into the gas wiping nozzle, and a wiping section arranged downstream of the inlet section. The wiping section has a gas outlet means therein, which surrounds the passage for blowing wiping gas against the surface of the wire being drawn therethrough. In accordance with an important aspect of the present invention, a protruding annular lip is arranged between said converging inlet section and said wiping section. This lip defines a narrower passage than said wiping section, so as to protect the gas outlet means in the wiping section from direct contact with the coated wire. The gas outlet means may include for example a continuous annular slit or several contiguous slits or orifices.

Such a lip arranged between the converging inlet section and the wiping section of a nozzle provides an efficient protection for the gas outlet means against direct contact with the molten metal coated wire. If a wire deviates from the central axis, it will contact the lip and not the gas outlet means. Moreover, the molten metal will remain under the lip and flow down to the diverging section, since the lip protrudes into the passage. The molten metal will consequently not fill the gas outlet means, and the gas wiping nozzle will not have to be cleaned or replaced.

Advantageously, the gas wiping nozzle includes contact detecting means for detecting a wire contacting said lip. The contact detecting means may include an electrically conductive ring arranged in an electrically insulated manner in the lip. It is easily understood that the metallic ring together with the wire may serve as a switch for the contact detecting means. A wire deviating from the central axis and contacting the lip may trigger an alarm so that the operator will be warned and can eliminate the malfunction.

The gas wiping nozzle may also include position detecting means surrounding said passage, for detecting a wire deviating from the central axis of said passage. The position detecting means preferably includes temperature, inductive or optical sensors, or laser means. Thereby, the operator can be warned of an imminent malfunction and immediately solve it.

Advantageously, a gas equalization chamber surrounds the passage in the gas wiping nozzle and communicates with the gas outlet means. The equalization chamber acts for dynamic pressure homogenization at the entrance of the gas cutlet means, thus contributing to an axisymmetric wiping gas distribution in the passage.

The gas wiping nozzle may include pressure sensors for measuring the wiping gas pressure in the equalization chamber. It becomes thereby possible to correlate the coating thickness and the wiping gas pressure.

In a first embodiment, a turbine rotor is arranged in the equalization chamber so as to be rotated by wiping gas injected into the equalization chamber. The turbine rotor along with the equalization chamber further contribute to a more homogeneous wiping gas distribution. The more homogeneous the air blast, the better the quality of the coating.

In a second embodiment, the turbine rotor defines part of the passage downstream of the wiping section. The gas outlet means then includes an annular slit defined between upper and lower annular surfaces, the upper annular surface being a surface of the turbine rotor. At least one cleaning means is then preferably attached to the upper annular surface so as to clean the annular slit while the turbine rotor is rotated by the wiping gas.

Rotation sensing means for measuring the number of revolutions per unit of time of the turbine rotor may also be used to correlate the coating thickness and the number of revolutions per unit of time.

BRIEF DESCRIPTION OF THE DRAWINGS

The present invention will be more apparent from the following description of a not limiting embodiment with reference to the attached drawings, wherein FIG. 1: is a longitudinal section of a first gas wiping nozzle;

FIG. 2: is a longitudinal section of the lip of the gas wiping nozzle of FIG. 1;

FIG. 3: is a section AA of the gas wiping nozzle of FIG. 1;

FIG. 4: is a longitudinal section of a second gas wiping nozzle;

FIG. 5: is a longitudinal section of a third gas wiping nozzle.

DETAILED DESCRIPTION OF THE PREFERRED EMBODIMENT

FIG. 1 shows a longitudinal section of a gas wiping nozzle 10 that is used in a wire coating apparatus for wiping excess molten metal off the surface of a wire coated with molten metal. A wire 12, represented by its axis, is drawn upwards from a molten metal bath 14 and passes through the nozzle 10 via a passage 16. It is drawn upwards by schematically represented drawing means 18, along a substantially vertical central axis 20, as shown by the arrow 21. The wire 12 enters the nozzle 10 through a converging inlet section 22, wherein the section of the passage 16 decreases in the drawing direction. A wiping section 24 situated downstream of the inlet section 22 comprises an annular gas outlet slit 26, for blowing wiping gas against the surface of the molten metal coated wire 12 passing through the nozzle 10.

It shall be appreciated that a protruding annular lip 28 is arranged between the inlet section 22 and the wiping section 24, preferably just beneath the gas outlet slit 26. Such a lip 28 provides a localized section reduction just before the gas outlet slit 26, which is thereby protected from direct contact with the molten metal coated wire 12. Indeed, a wire 12 deviating from the central axis 20 cannot come into contact with the gas outlet slit 26 since the lip 28 will keep it spaced from the gas outlet slit 26.

FIG. 2 shows a longitudinal section of the lip 28. In order to detect a wire 12 contacting the lip 28, a metallic ring 30 is arranged in an annular groove 32 in the lip 28. The metallic ring 30 is insulated from the body of the nozzle 10, and in particular from the lip 28, by insulating material 34 inserted in the annular groove 32 between the ring 30 and the nozzle 10. It can easily be understood that the metallic ring 30 and the wire 12 serve as a switch that triggers an alarm in case of contact between the wire 12 and the lip 28. An operator warned by the alarm can stop or intervene in the coating process to repair the malfunction.

Turning now to FIG. 3, four sensors 36 are arranged at the same level downstream the gas outlet slit 26, in the passage walls, and are regularly spaced about the circumference of the passage 16. These four sensors 36 are part of position detecting means, enabling the detection of a wire 12 deviating from the central axis 20, before it contacts the lip 28.

The configuration shown in FIG. 3 is e.g. suitable for temperature or inductive sensors. The four sensors 36 deliver four signals which are permanently compared to each other by the position detecting means. When the wire 12 is in the center of the passage 16, i.e. aligned along the central axis 20, the four sensors 36 deliver the same signal. Hence, if one of the signals differs from the others, the wire 12 has deviated from the central axis 20.

It is possible to detect the position of the wire 12 by using optical sensors, such as light beams and photoelectric cells.

A further possibility is the use of two perpendicular laser beams impinging on the wire 12. When a wire 12 deviates from the central axis 20, the laser beam reflects on the opposite passage wall instead of reflecting on the wire 12. The return time of the laser beam increases, thereby signaling the deviation of the wire 12.

FIG. 4 shows a longitudinal section of a second nozzle 38. As in FIG. 1, a wire 12 is drawn through the nozzle 38 along a central axis 20, via a passage 16, in the direction indicated by arrow 21. The wire 12 enters the nozzle 38 through a converging inlet section 40, passes through a wiping section 42, then through a tubular section 44, and exits the nozzle 38 through a diverging section 46. The wiping section 42 comprises a gas outlet slit 26 for wiping excess molten metal off the surface of the wire 12. A lip 28 equipped with a metallic ring 30, similar to the lip of FIG. 1, is located just before the gas outlet slit 26. As explained above, the lip 28 protects the gas outlet slit 26 from direct contact with the wire 12. The arrow 48 indicates a gas inlet 49 in an equalization chamber 50 surrounding the passage 16 and communicating with the gas outlet slit 26. A turbine rotor 52 is installed in the equalization chamber 50 and surrounds the passage 16 as well. Wiping gas, e.g. nitrogen (N2), is supplied to the equalization chamber 50 through the gas inlet 49 and impinges on the turbine rotor 52, which is thereby rotated. The equalization chamber 50 and the turbine rotor 52 facilitate the homogenization of the pressure of the wiping gas, before being blown through the gas outlet slit 26.

Reference sign 53 generally indicates a pressure sensor installed in the body of the nozzle 38, for measuring the wiping gas pressure in the equalization chamber 50. It is thereby possible to correlate the thickness of the molten metal coating and the wiping gas pressure in the equalization chamber 50.

It shall be noted that the nozzle 10 of FIG. 1 is also equipped with an equalization chamber 50 and pressure sensors 53.

Besides, a rotation sensing means is installed in the nozzle 38. The rotation sensing means comprises e.g. a magnet 54 embedded in the turbine rotor 52, and an inductive sensor 56 is installed in the body of the nozzle 38 so as to be on the trajectory of the magnet 54. The inductive sensor 56 detects the presence of the magnet 54 once per revolution. It is thereby possible to determine the number of revolutions per unit of time, and thereby to correlate the thickness of the molten metal coating with the number of revolutions per unit of time. The flow rate, which is a function of the speed of the turbine rotor 52 and the pressure, may also be determined.

FIG. 5 shows a third embodiment of a gas wiping nozzle 58. As in FIG. 4, a wire 12 is drawn through the nozzle 58 along a central axis 20, via a passage 16, in the direction indicated by arrow 21. The structure of the passage 16 is different: the wire 12 enters the nozzle 58 through a converging inlet section 60, passes through a wiping section 62, then through a diverging section 64. The wiping section 62 comprises a gas outlet slit 26 for wiping excess molten metal of the surface of the wire 12. A lip 28 equipped with a metallic ring 30, similar to the lip of FIG. 1, is located just before the gas outlet slit 26. As explained, the lip 28 protects the gas outlet slit 26 from direct contact with the wire 12.

In this third embodiment, the equalization chamber 50 is isolated from the passage 16 by a turbine rotor 66. In other words, a central channel through the turbine rotor 66 defines a part of the passage 16. It should be noted that the gas outlet slit 26 is defined by upper and lower annular surfaces 68 resp. 70. The upper annular surface 68 is part of the turbine rotor 66. Hence, when the turbine rotor 66 is rotated, due to the wiping gas in the equalization chamber 50, the upper 68 annular surface is rotated as well. Reference sign 72 generally identifies a small brush. Three radial brushes 72 are preferably attached to the upper annular surface 68. When the turbine rotor 66 is rotated, the brushes 72 sweep the lower annular surface 70 and the gas blast clears the gas wiping slit 26. This third nozzle 58 can be regarded as a self-cleaning nozzle 58. The rotation of the turbine rotor 66 may be stopped by electromagnetic or mechanical means (not shown), in order to allow cleaning only when desired.

It shall be noted that each of the gas wiping nozzles respectively 10, 38 and 58 may be embodied as a split nozzle, consisting of two or more body parts. Thus, the wire does not have to be threaded through the passage of the nozzle, but rather the body parts are separated while the wire is positioned in the coating apparatus, and the body parts are then brought together in abutment about the wire.

What is claimed is:

1. A gas wiping nozzle for a wire coating apparatus comprising:

an inlet portion defining a converging inlet passage for a coated wire that is axially drawn through said gas wiping nozzle;

a wiping portion defining a wiping passage for said coated wire, downstream and in axial extension of said inlet passage, said wiping portion including gas outlet means surrounding said wiping passage for blowing wiping gas onto said coated wire; and a protruding annular lip arranged between said converging inlet passage and said wiping passage, wherein said annular lip defines a passage for said coated wire that is narrower than said wiping passage, so that said gas outlet means in said wiping passage is protected by said protruding annular lip against direct contact with said coated wire, which is axially drawn through said passages of said gas wiping nozzle.

2. The gas wiping nozzle as claimed in claim 1, further comprising contact detecting means for detecting a coated wire contacting said annular lip.

3. The gas wiping nozzle as claimed in claim 2, wherein said contact detecting means includes an electrically conductive ring arranged in an electrically insulated manner in said annular lip.

4. The gas wiping nozzle as claimed in claim 1, further comprising position detecting means for detecting a coated wire that deviates from the central axis of said passages in said wiping nozzle.

5. The gas wiping nozzle as claimed in claim 4, wherein said position detecting means includes a thermal and/or inductive and/or optical sensor.

6. The gas wiping nozzle as claimed in claim 4, wherein said position detecting means includes at least one optical sensor and one laser.

7. The gas wiping nozzle as claimed in claim 1, further comprising an annular gas equalization chamber that is in communication with said gas outlet means.

8. The gas wiping nozzle as claimed in claim 7, further comprising at least one pressure sensor for measuring the wiping gas pressure in said equalization chamber.

9. The gas wiping nozzle as claimed in claim 7, further comprising a turbine rotor arranged in said equalization chamber so as to be rotated by wiping gas injected into said equalization chamber.

10. The gas wiping nozzle as claimed in claim 9, wherein said turbine rotor defines a passage for said coated wire, downstream and in axial extension of said wiping section.

11. The gas wiping nozzle as claimed in claim 10, wherein:

said gas outlet means includes an annular slit defined between upper and lower annular surfaces;

said upper annular surface is a surface of said turbine rotor; and at least one cleaning means is attached to said upper annular surface so as to clean said annular slit while said turbine rotor is rotated.

12. The gas wiping nozzle as claimed in claim 9, further comprising rotation sensing means for measuring the number of revolutions per unit of time of said turbine rotor.

* * * * *